US006367951B1

(12) United States Patent
Kumada et al.

(10) Patent No.: US 6,367,951 B1
(45) Date of Patent: Apr. 9, 2002

(54) ECONOMICAL NET OR MESH LIGHT SET

(75) Inventors: Isao Kumada, Atsug (JP); Najeh Rahman, Monsey, NY (US)

(73) Assignee: Minami International Corporation, Yonkers, NY (US)

( * ) Notice: Subject to any disclaimer, the term of this patent is extended or adjusted under 35 U.S.C. 154(b) by 0 days.

(21) Appl. No.: 09/537,700

(22) Filed: Mar. 28, 2000

Related U.S. Application Data

(63) Continuation-in-part of application No. 08/992,988, filed on Dec. 18, 1997, now Pat. No. 5,975,717, which is a continuation-in-part of application No. 08/988,489, filed on Dec. 10, 1997, now Pat. No. 5,934,793, which is a continuation-in-part of application No. 09/244,647, filed on Feb. 4, 1999.

(30) Foreign Application Priority Data

Feb. 28, 2000 (CN) ..... 00 2 27444 U

(51) Int. Cl.[7] ..... F21V 21/00

(52) U.S. Cl. ..... 362/249; 362/391; 362/251; 362/252; 362/806

(58) Field of Search ..... 362/249, 251, 362/252, 806, 391

(56) References Cited

U.S. PATENT DOCUMENTS 6,135,616 A * 10/2000 Rahman ..... 362/249
9,537,700 * 10/2000 Byers ..... 362/252

* cited by examiner

*Primary Examiner*—Stephen Husar
*Assistant Examiner*—Anabel Ton
(74) *Attorney, Agent, or Firm*—Locke Liddell & Sapp LLP; Monty L. Ross

(57) ABSTRACT

An economical method of making a net or mesh light with light nodes includes the step of providing a light set having a common wire collection extending in a first direction, the common wire collection including an active wire and a return wire. A plurality of series-connected light strings extend physically parallel to each other and in a second direction substantially transverse to the first direction, each light string including a plurality of lamp sockets and a plurality of intermediate lengths of wire connecting the lamp sockets in series. Plug means are disposed at one end of the common wire collection and include the active and return wires. Then at least one non-electrical rope is physically fastened to the lamp sockets of the plurality of light strings removed a common distance along the second direction from the common wire collection, thereby forming a net or mesh.

20 Claims, 9 Drawing Sheets

ECONOMICAL NET OR MESH LIGHT SET

CROSS-REFERENCE TO RELATED APPLICATIONS

This application is a continuation-in-part of U.S. patent application Ser. No. 08/992,988, filed Dec. 18, 1997 now U.S. Pat. No. 5,975,717, Ser. No. 08/988,489, filed Dec. 10, 1997, now U.S. Pat. No. 5,934,793 and Ser. No. 09/224,647, filed Feb. 4, 1999, a continuation-in-part of the two earlier applications.

BACKGROUND OF THE INVENTION

The present invention relates to a method of making a net light, whether with or without light sockets located at the nodes (e.g., light sockets located at the intersections of the wires) to form a net, and more particularly to such a method which is easier and more economical than that conventionally used to make a net light.

Net lights are well known in the art and typically constitute a matrix of light bulbs or lamps in light sockets disposed so as to form a net light defined by horizontal rows and vertical columns of light bulbs.

As illustrated as in U.S. patent application Ser. No. 08/992,998, filed Dec. 18, 1997, in FIGS. 1A and 1B a method of forming such a net light, generally designated by the reference numeral 10A, comprises providing a linear light set 20A (as illustrated in FIG. 1A), and then, through the use of various non-electrical physical connectors or fasteners 24 (represented as rectangles for ease of interpretation), physically configuring the linear light set 20A to simulate a net light 10A (as illustrated in FIG. 1B). The linear light set 20A illustrated in FIG. 1A and the net light illustrated in FIG. 1B each include a plug or current tap 14. Primarily for aesthetic purposes, the various non-electrical physical connectors 24 may be disposed on a horizontally extending electrically inactive wire or cord (not shown) in order to further the impression of a net light system. The positioning of the connectors 24 along the electrically inactive wire or cord may facilitate the manufacturing process by pre-positioning the connectors 24 therealong.

The arrows of FIG. 1B represent how the light set 20A is physically laid out such that a light net 10A results from appropriate placement of the physical connectors 24.

Referring now to FIGS. 2A and 2B, therein illustrated are a light set and net light similar to those illustrated in FIGS. 1A and 1B, respectively, but with each light set 20B being adapted to be manually joined to another light set 20B' via an assembly of its end connector 30 and a plug 14' of the other light set 20B', and with each light set 20B, 20B' comprising a plurality of parallel-wired sub-sets 32 to form an extended net light.

More particularly, FIG. 1A shows a fixed linear light set 20A having fifty lamp sockets L1 through L50 connected by intermediate lengths 22 of wire, while FIG. 2A shows an extended linear light set construction wherein at least two light sets 20B, 20B' are connected electrically in parallel (the second set 20B' being illustrated only partially and in phantom line) and wherein each light set 20B is electrically divided into at least two parallel-wired light sub-sets 32B, 32B' each having fifty light sockets L1-L50, L51-L100 (represented as circles for ease of interpretation) connected in series by intermediate lengths 22 of wire. Where the extended linear light set has a plurality of light sets 20B, 20B' but does not include light sub-sets 32B, the application of the full voltage differential from the plug 14 or first lamp socket L1, L51 to the end connectors 30 or last lamp socket L50, L100 may be accomplished either by a single light set bypass wire B (not shown) or by a series of sub-set bypass wires B' (as illustrated), as the two techniques are functionally equivalent to ensure all light sets 20B, 20B' receiving full line voltage.

A light set bypass wire B of a first light set 20B extends from the plug means 14 (or the first lamp socket L1 thereafter), follows the active wire A and return wire R, and terminates with return wire R in the end connector 30 (or the last lamp socket Ln therebefore) so that the plug 14' of a second light set 20B' inserted into the end connector 30 of the first light set 20B receives a full line voltage equivalent to that received by the first light set 20B.

Each extended linear light set 20B, 20B' may comprise in turn a plurality of light sub-sets 32B wired in parallel so that the first lamp socket of each sub-set 32B has full line voltage applied to it. Assuming a pair of 50-bulb sub-sets 32B, 32B' a sub-set bypass wire B' extends from plug 14 (or the first lamp socket L1 thereafter of the first sub-set) to lamp socket L50, and another extends from lamp socket L51 of the second sub-set 32B' to the end connector 30 (or the last lamp socket L100 of the second sub-set 32B'). Clearly, additional sub-sets may be employed, and the number of bulbs or lamp sockets in each sub-set may vary from 50.

It will be appreciated that, while the initial linear light set 20A of FIG. 1A has been expanded to an extended linear light set 20B of FIG. 2A both by the use of at least one additional plug-in light set 20B' and by the use of a plurality of sub-sets 32B within each light set, the linear light set 20A may be expanded by the use of only one of these techniques, if preferred. The light sets 20B, 20B' illustrated in FIG. 2A may be expanded to each include any plurality of sub-sets 32B (and sub-set bypass wires B'), and the net light 10B illustrated in FIG. 2B may include any plurality of light sets 20B, 20B' (each but the last including a light set bypass wire B and an end connector 30). In those instances where a light set 20B includes a plurality of sub-sets 32B, but is not to be connected with a following light set 20B', the sub-set bypass wire B' of the last sub-set thereof (adjacent the end connector 30) may be omitted and, indeed, the end connector 30 itself may be omitted.

It will be readily appreciated by those skilled in the electrical arts that the amount of wire utilized by the prior art net light constructions 10A and 10B of FIGS. 1A and 1B, respectively, are enormous since the active wire A, the return wire R, and the bypass wire B, B' extend substantially the entire stretched-out length of the conventional light sets 20A, 20B. Wire costs are perhaps the most significant element in the cost of a net light.

In the United States, the UL ("Underwriters Laboratory") approves of a net light only where the active and return wires A, R are twisted together on each light string (the only permissible alternative being the use of a very thick wire, which would render the product economically unfeasible). Thus, while net lights are quite popular, especially as Christmas decorations (e.g., for use on a Christmas tree, over bushes, or the like), and while the sheer volume of sales thereof has enabled the purchase price of such sets to be substantially reduced, the manufacture of such a net light is necessarily complex and labor-intensive (and hence expensive) when made by conventional process techniques to produce a net light meeting various federal, state and UL (Underwriters Laboratory) requirements.

Thus, in addition to the aforenoted economic difficulties, the conventional net light presents manufacturing difficulties. In order to maintain the active, return and bypass wires A, R, B twisted together in the net light, rather long lengths of the linear light set must be used, so that the creation of each linear light set may involve working with wire lengths as long as 25, 50 or 75 feet, depending upon the number of sub-sets in a light set. The need to maintain a lengthy linear light set in a relatively sinuous net-like disposition (prior to application of the connectors) can create problems in the process of manufacture and necessitate the use of expensive hand labor steps rather than relatively inexpensive automated equipment steps.

Accordingly, it is an object of the present invention to provide a method of making a net light which is easier and more economical than that conventionally used to make net lights.

Another object is to provide such a method which produces a net light with or without lamp sockets and lamps located at the nodes, as desired.

A further object is to provide such a method which reduces the extended length of the light set employed in forming the net light.

It is also an object of a preferred embodiment of the present invention is to provide a net or mesh light set (with lamp sockets and lamps located at the nodes) which is simple and economical to manufacture, use and maintain.

It is another object of the preferred embodiment to provide such a light set wherein the initially parallel light strings thereof remain parallel even after the several light strings have been secured together.

It is a further object of the preferred embodiment to provide a simple and economical method of making such a light set.

SUMMARY OF THE INVENTION

It has now been found that the above and related objects of the present invention are obtained in a first embodiment of a method of making a light set comprising the following steps. Initially, provide a light set having (i) a common wire means extending in a first direction, the common wire means including an active wire and a return wire, and (ii) a plurality of series-connected light strings extending physically parallel to each other and in a second direction transverse to the first direction. Each light string includes a plurality of lamp sockets and a plurality of intermediate lengths of wire connecting the lamp sockets in series electrically. Each of the light strings, except the first and last light string, is disposed in relatively closely adjacent pairs of light strings, each such closely adjacent pair being relatively widely spaced from any other closely adjacent pair, the first light string, and the last light string. A plug means is disposed at one end of the common wire means and includes the active and return wires. Then, (i) physically fasten intermediate lengths of each light string of a closely adjacent pair to corresponding intermediate lengths of an adjacent one light string of a different closely adjacent pair, (ii) physically fasten intermediate lengths of the first light string to corresponding intermediate lengths of the second light string, and (iii) physically fasten intermediate lengths of the last light string to corresponding intermediate lengths of the penultimate light string; thereby to form a light net without light sockets located at the nodes.

In a preferred embodiment, the first and last light strings are spaced from the adjacent light string by about one-half of the spacing between widely spaced adjacent pairs. The adjacent light strings to the first and last light strings are the second and penultimate light strings, respectively. The fastening steps reduce the effective length of each light string other than the first and last light string.

In an especially preferred embodiment, the light set is in turn comprised of a plurality of light sub-sets wired in parallel. Each light sub-set includes a common wire means portion extending in the first direction, the common wire means portion including the active wire, the return wire, and a sub-set bypass wire, and a plurality of series-connected light strings extending physically parallel to each other, and in a second direction transverse to the first direction. Each light string includes a plurality of lamp sockets and a plurality of intermediate lengths of wire electrically and physically connecting the lamp sockets in series. Substantially each of the light strings is disposed in relatively closely adjacent pairs of light strings, each such closely adjacent pair being relatively widely spaced from any other closely adjacent pair. Preferably each light string comprises an active wire and a return wire. The active, return and bypass wires are physically twisted together in the common wire means portion, and the active and return wires are physically twisted together in each light string.

The present invention also encompasses a method of making a net light without light sockets located at the nodes from a plurality of light sets. The initial step comprises providing a plurality of parallel wired light sets, at least one of the light sets having a common wire means extending in a first direction, the common wire means including an active wire, a return wire, and a bypass wire, and connector means disposed at an opposite end of the common wire means and including the bypass and return wires. Preferably each light set is in turn comprised of a plurality of series wired light sub-sets wired in parallel to each other, each light sub-set including a common wire means portion extending in the first direction, the common wire means portion including the active wire, the return wire, and the bypass wire.

The present invention further encompasses a method of making a net light with light sockets and lamps at the nodes comprising the fastening steps of; (i) physically fastening the lamp sockets of one light string of a closely adjacent pair to the corresponding intermediate lengths of an adjacent light string of a different closely adjacent pair, (ii) physically fastening intermediate lengths of the first light string to the lamp sockets of a next adjacent light string, and (iii) physically fastening intermediate lengths of the last light string to the lamp sockets of a next adjacent light string; thereby to form a light net with light nodes. Preferably the light set is in turn comprised of a plurality of light sub-sets wired in parallel, each light sub-set including a common wire means portion extending in the first direction, the common wire means portion including the active wire, the return wire, and the bypass wire.

The present invention also encompasses a method of making a net light with lights at the nodes from a plurality of light sets comprising the following steps: Provide a plurality of parallel wired light sets, at least one light set having a common wire means extending in a first direction, the common wire means including an active wire, a return wire and a bypass wire. Then, (i) physically fasten the lamp sockets of one light string of a closely adjacent pair to the corresponding intermediate lengths of an adjacent light string of a different closely adjacent pair, (ii) physically fasten intermediate lengths of the first light string to the lamp sockets of the next adjacent light string, or physically fastening lamp sockets of the first light string to intermediate lengths of the next adjacent light string, and (iii) physically fasten intermediate lengths of the last light string to the lamp sockets of the next adjacent light string or physically fastening lamp sockets of the last light string to intermediate lengths of the next adjacent light string; thereby to form a light net with lights at the nodes. Preferably each light set is in turn comprised of a plurality of series wired light sub-sets wired in parallel to each other, each light sub-set including a common wire means portion extending in the first direction, the common wire means portion including the active wire, the return wire, and the bypass wire.

In each embodiment, the active, return and optional bypass wires are physically twisted together in the common wire means, and the active and return wires are physically twisted together in each light string.

A net light made according to one of the above-described methods is also encompassed by the present invention.

The present invention also encompasses an economical method of making a net or mesh light with light at the nodes comprises the step of providing a light set having a common wire means extending in a first direction, the common wire means including an active wire and a return wire (and optionally a bypass wire). A plurality of series-connected light strings extends physically parallel to each other and in a second direction substantially transverse to said first direction, each light string including a plurality of lamp sockets and a plurality of intermediate lengths of wire connecting the lamp sockets in series. A plug means is disposed at one end of the common wire means and includes the active and return (or optionally bypass and return) wires. In the next step a non-electrical rope is physically fastened to the lamp sockets of the plurality of light strings removed a common distance along the second direction from the common wire means, thereby forming a mesh.

In a preferred embodiment the light set is in turn comprised of a plurality of light sub-sets wired in parallel, each light sub-set including a common wire means portion extending in said first direction, the common wire means portion including the active and return wires, and a plurality of series-connected light strings extending physically parallel to each other and in the second direction substantially transverse to the first direction. Each light string includes a plurality of lamp sockets and a plurality of intermediate lengths of wire electrically and physically connecting the lamp sockets in series.

Preferably each light string comprises an active wire and a return wire, the active wire and return wire (and optionally a bypass wire) being physically twisted together in the common wire means portion, and the active and return wires being physically twisted together in each light string. Optionally, connector means are disposed at an opposite end of the common wire means and include the bypass and return wires.

The invention further encompasses an economical net light with light nodes comprising a light set. The light set has a common wire means extending in a first direction, the common wire means including an active wire and a return wire (and optionally a bypass wire); a plurality of series-connected light strings extending physically parallel to each other and in a second direction substantially transverse to the first direction, each light string including a plurality of lamp sockets and a plurality of intermediate lengths of wire connecting the lamp sockets in series; and plug means disposed at one end of the common wire means and including the active and return (or optional bypass and return) wires. Additionally, the light set has a non-electrical rope physically fastened to the lamp sockets of the plurality of light strings removed a common distance along the second direction from the common wire means, thereby forming a mesh.

Optionally connector means are disposed at an opposite end of the common wire means and include the bypass and return wires.

BRIEF DESCRIPTION OF THE DRAWING

The above and related objects, features and advantages of the present invention will be more fully understood by reference to the following detailed description of the presently preferred, albeit illustrative, embodiments of the present invention wherein.

DETAILED DESCRIPTION OF THE PREFERRED EMBODIMENTS

Figure 3A:
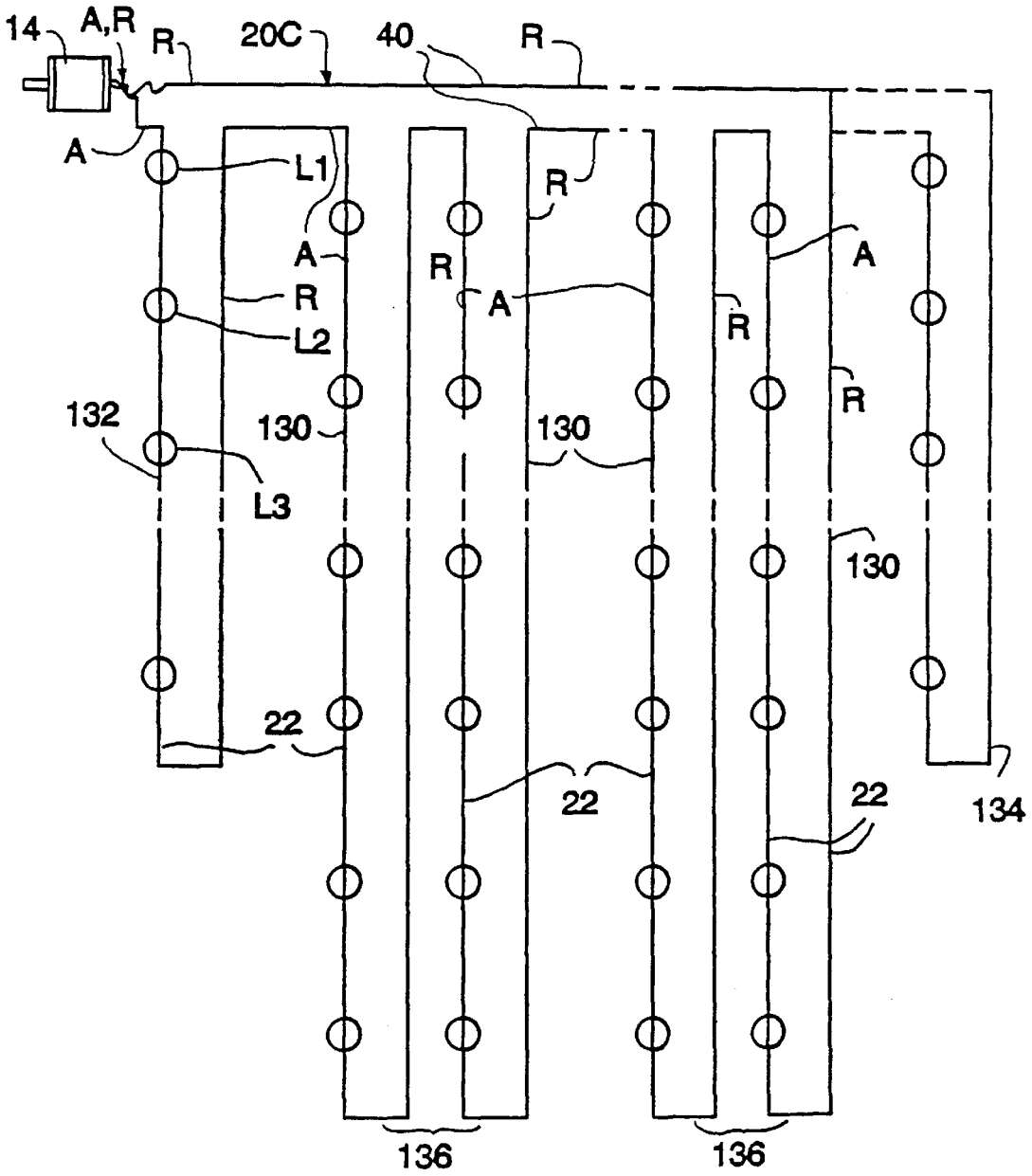
FIG. 3A is a circuit diagram and physical layout of a first embodiment of a light set adapted for use in the present invention.
Figure 3B:
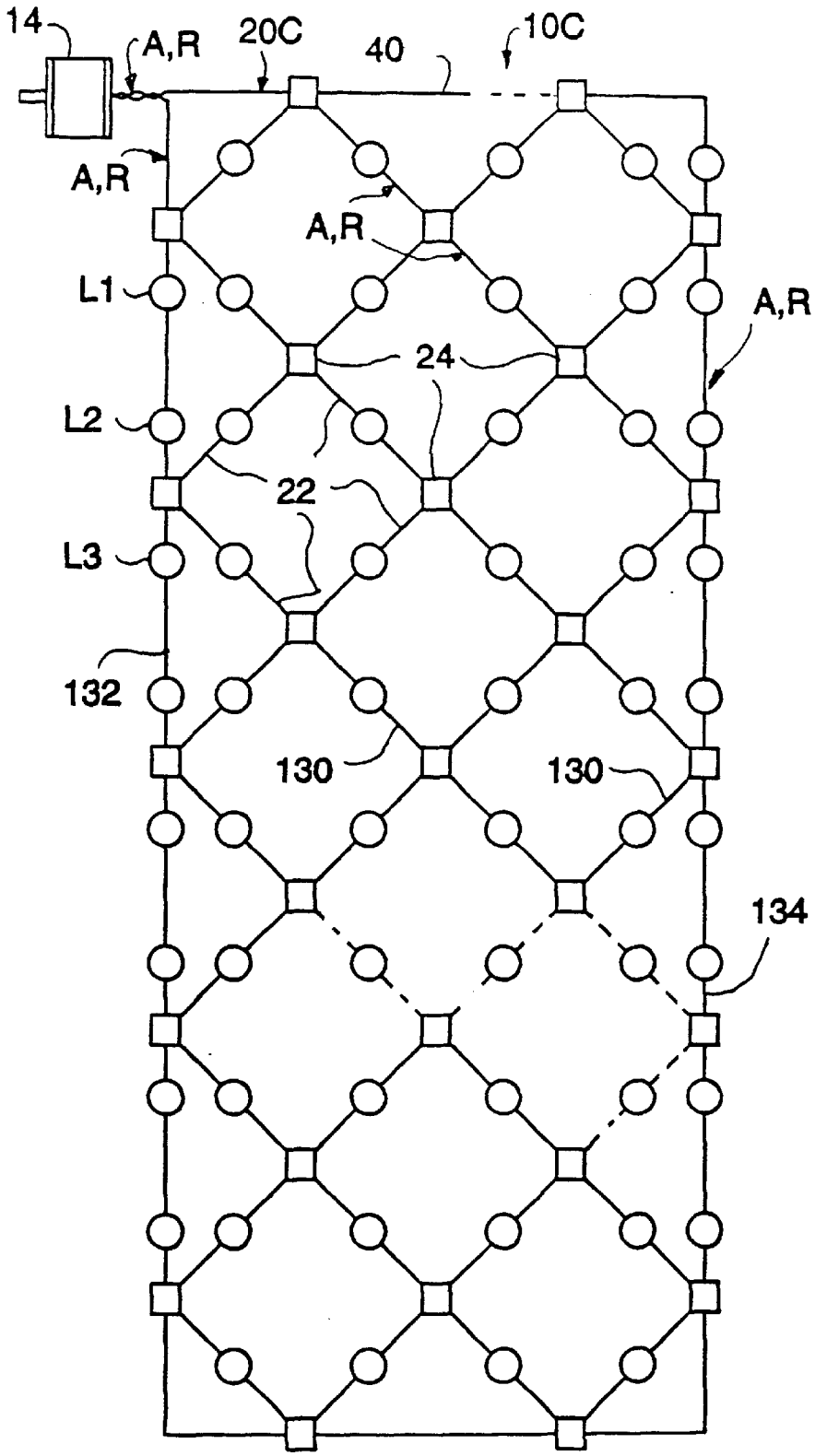
FIG. 3B is a circuit diagram and physical layout for the net light according to the present invention formed from the light set of FIG. 3A.

Referring now to FIGS. 3A and 3B, the present invention provides a method of making a net light 10C according to the present invention, the method comprising the steps of providing a suitable single light set 20C and then physically fastening portions thereof together with non-electrical physical connectors 24 to form a net light 10C without lights at the nodes.

Referring now to FIG. 3A, the single light set 20C includes a common wire means 40 extending in a first direction (typically horizontally as illustrated) with the various wires thereof (typically an active wire A and a return wire R) being twisted together. A plurality of series-connected light strings 130 extend physically parallel to each other and in a second direction (typically vertically as illustrated) transverse to the first direction--e.g., the light strings 130 depend from the common wire means 40. Each light string 130 includes a plurality of lamp sockets L1, L2, . . . Ln, and a plurality of intermediate lengths 22 of wire connecting the lamp sockets L1, L2 . . . Ln in series. Each of the light strings 130 of the light set 20C, except the first light string 132 and last light string 134, is disposed in relatively closely adjacent pairs 136 of light strings 130.

Each closely adjacent pair 136 of light strings 130 is relatively widely spaced from any other closely adjacent pair 136 of light strings 130, from the first light string 132 of the light set, and from the last light string 134 of the light set.

The single light set 20C of FIG. 3A is easily converted into the net light 10C of FIG. 3B by the following steps: The intermediate lengths 22 of each light string 130 of a closely adjacent pair 136 are physically fastened to corresponding and horizontally aligned intermediate lengths 22 of an adjacent one light string 130 of a different closely adjacent pair 136 using connectors 24 to physically fasten the intermediate lengths 22. The intermediate lengths 22 of the first light string 132 are physically fastened to corresponding intermediate lengths 22 of the second light string 130 immediately adjacent thereto using connectors 24, and intermediate lengths 22 of the last light string 134 are physically fastened to corresponding intermediate lengths 22 of the penultimate light string 130 immediately adjacent thereto using connectors 24. The result is a net light 10C formed without lights at the nodes--that is, there are no lamp sockets disposed at the meetings or nodes of two adjacent light strings 130.

The first and last light strings 132, 134 of the light set 20C, 20C' remain substantially vertically oriented so that the effective vertical length dimension of the light strings 132, 134 remains unchanged by the physical fastening process. On the other hand, the intermediate light strings (that is, the light strings 130 between the first and last light strings 132, 134) assume a zig-zag configuration such that the effective vertical length dimension of each intermediate light string is substantially shortened by the physical fastening process.

Preferably the first and last light strings 132, 134 are spaced from the adjacent light string (the second light string in the case of the first light string 132 and the penultimate light string in the case of the last light string 134) by about one half of the lateral spacing between widely spaced adjacent pairs 136.

Figure 4A:
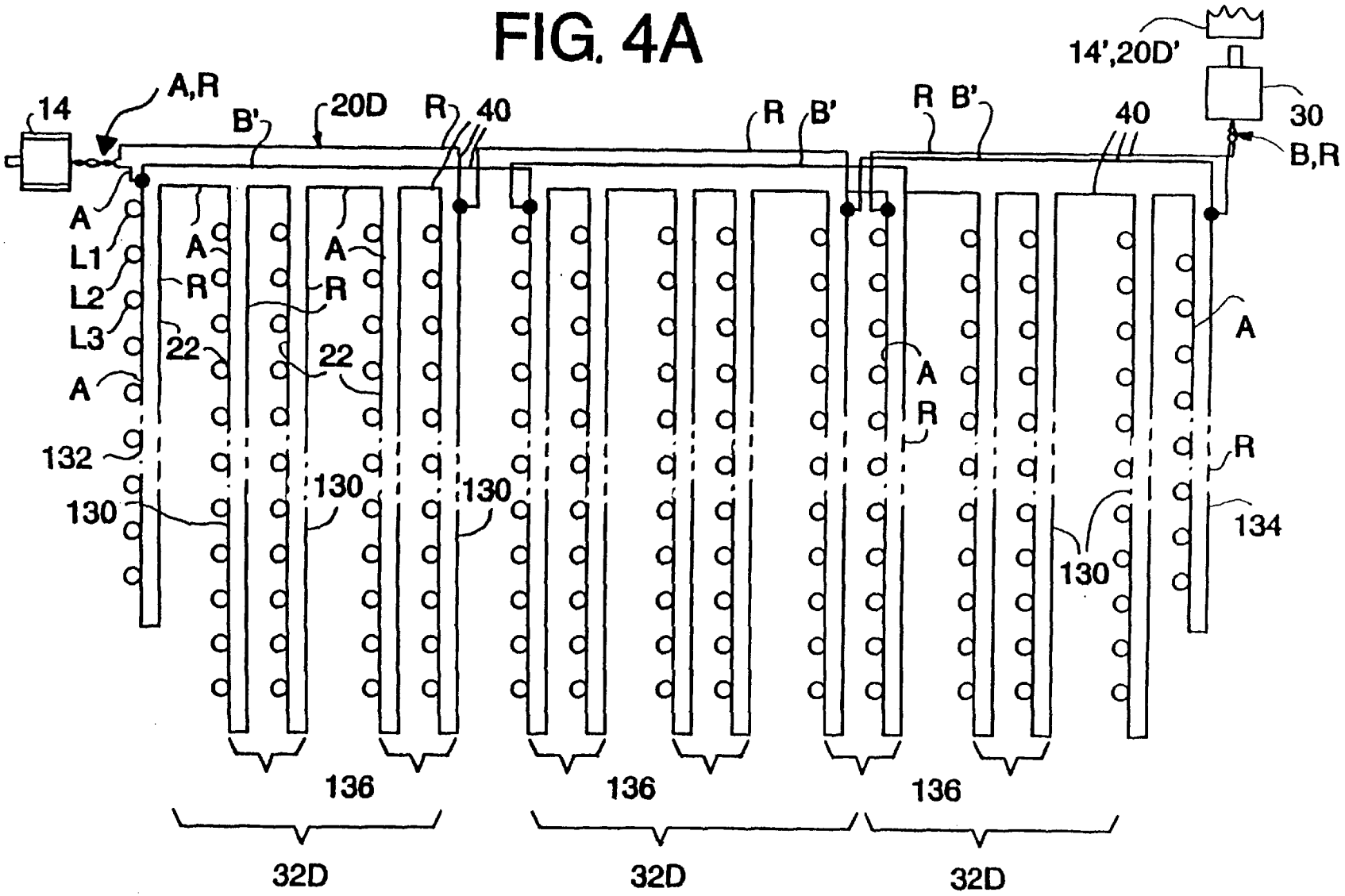
FIG. 4A is a circuit diagram and physical layout of a second embodiment of a plurality of light sets adapted for use in the present invention.
Figure 4B:
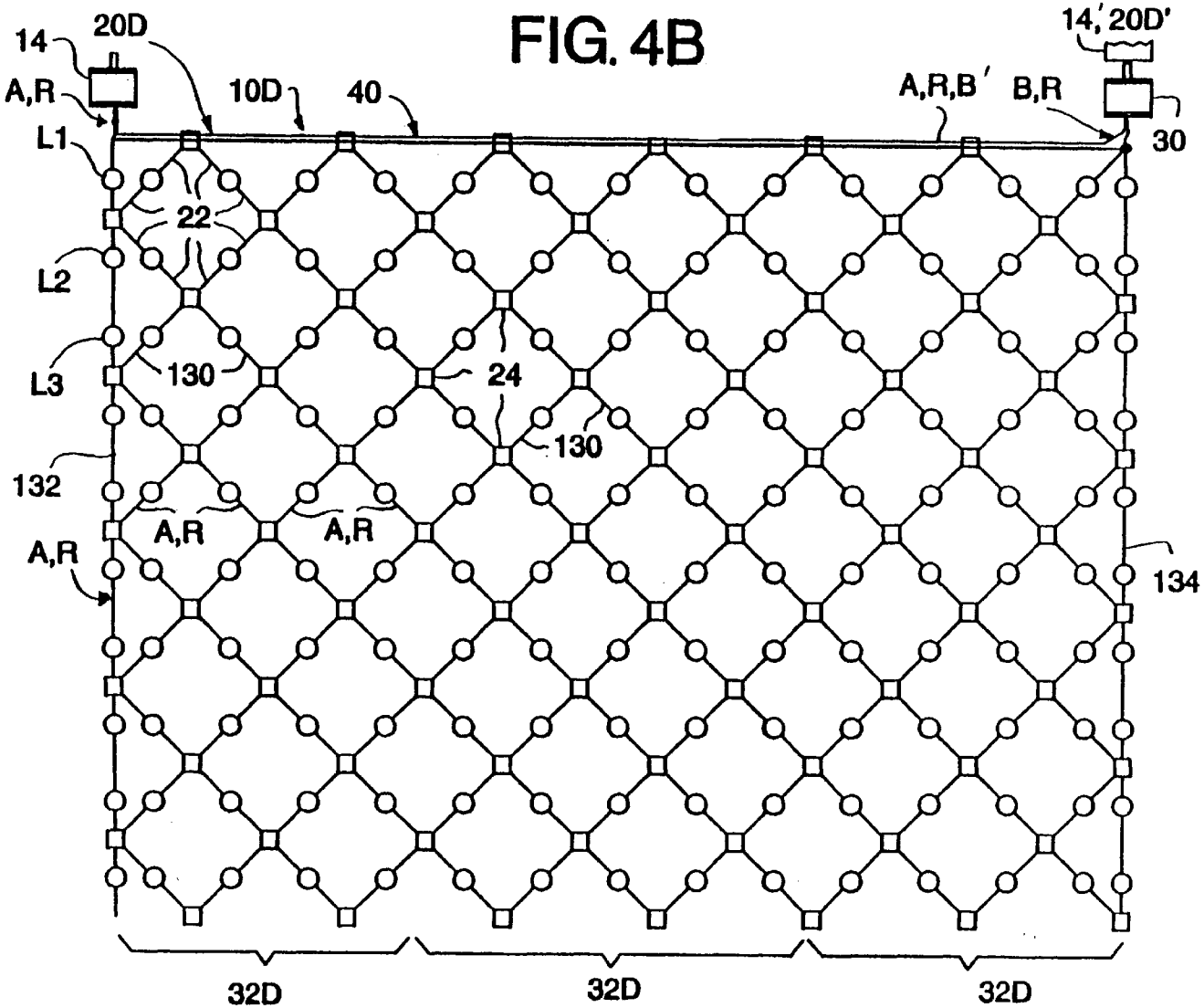
FIG. 4B is a circuit diagram and physical layout for the net light according to the present invention formed from the light sets of FIG. 3A.

Referring now to FIGS. 4A and 4B, a preferred net light 10D is formed of a plurality of parallel-wired light sets (two such light sets 20D, 20D' electrically wired in parallel being illustrated), and each light set is in turn formed of a plurality of series wired sub-sets 32D wired in parallel to each other. The common wire means portion 40 of each sub-set 32D includes an active wire A, a return wire R, and a sub-set bypass wire B'. The return wire R and bypass wire B are electrically connected to an end connector 30.

More particularly, FIG. 4A discloses a plurality of parallel-wired light sets 20D, 20D', one light set 20D being illustrated in solid line and the other 20D' being wired in parallel and partially illustrated in phantom line. At least one of the light sets 20D, 20D' (and preferably all of them) has a common wire means 40 extending in a first direction. The common wire means 40 of this embodiment includes an active wire A, a return wire R, and a bypass wire B. For this reason, the voltage of active wire A presented by the plug 14 of the first light set 20D is carried forward to the end connector 30 thereof via bypass wire B. This may be achieved directly in a single light set having only one sub-set by a light set bypass wire B extending from the plug 14 (or first lamp socket) to the end connector 30 (or the last lamp socket of that light set), thereby to present the full voltage to the end connector 30. (As illustrated, however, the light set bypass wire B is functionally formed by a plurality of sub-set bypass wires B' wired in series as to extend from the first lamp socket L1 of the first sub-set 32D (or the plug 14) to the first lamp socket of the next sub-set 32D and so on until the last sub-set 32D where it extends to the last lamp socket Ln of the last sub-set 32D (or the end connector 30).)

FIG. 4B also discloses each of light sets 20D, 20D' being optionally comprised of a plurality of series wired light sub-sets wired in parallel to each other (three such sub-sets 32D being illustrated in FIG. 4A). The common wire means portion 40 of each sub-set 32D includes an active wire A, a return wire R, and a sub-set bypass wire B' (except for the last sub-set 32D if there is no end connector 30). Where, as illustrated, the net light 10D includes a plurality of parallel-wired light sets 20D, 20D', each light set 20D, 20D' includes a plurality of parallel-wired light sub-sets 32D, the common wire means portion 40 of each light sub-set 32D including an active wire A, a return wire R, and a sub-set bypass wire B', as illustrated in FIG. 4A. The various sub-set bypass wires B' for the various sub-sets 32D cooperate to form the functional equivalent of a single light set bypass wire B extending from the plug 14 (or the first lamp socket adjacent thereto) to the end connector 30 (or the last light socket adjacent thereto).

Figure 5A:
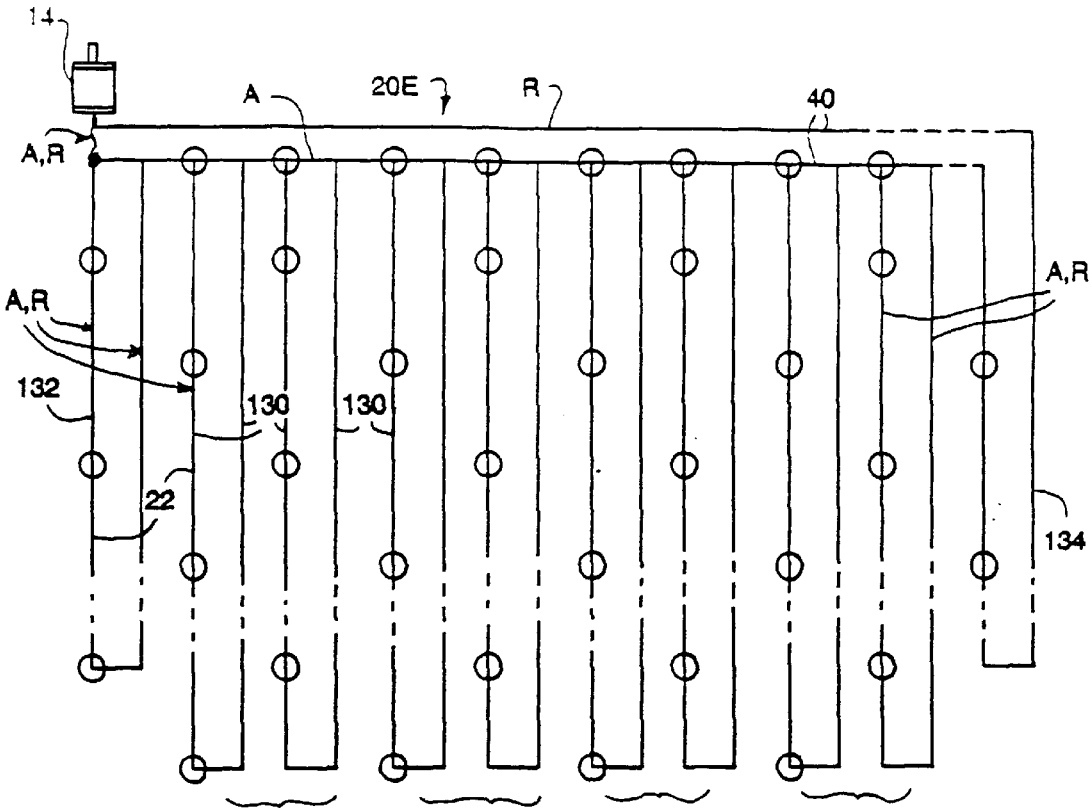
FIG. 5A is a circuit diagram and physical layout of a third embodiment of a light set adapted for use in the present invention.

Referring now to FIG. 5A, if it is desired to make a net light 10E with lights at the nodes, the relative dispositions of the lamp sockets L1, L2 . . . Ln on the various light strings 130 of light set 20E are rearranged so that the lamp sockets of one of the closely adjacent pairs 136 of light strings are disposed intermediate the lamp sockets of the other of the closely adjacent pair 136 --i.e., horizontally aligned with its intermediate wire length 22. The lamp sockets of the first and last light strings 132, 134 are disposed similarly with regard to the lamp sockets of the second and the penultimate light strings 130, respectively.

Figure 5B:
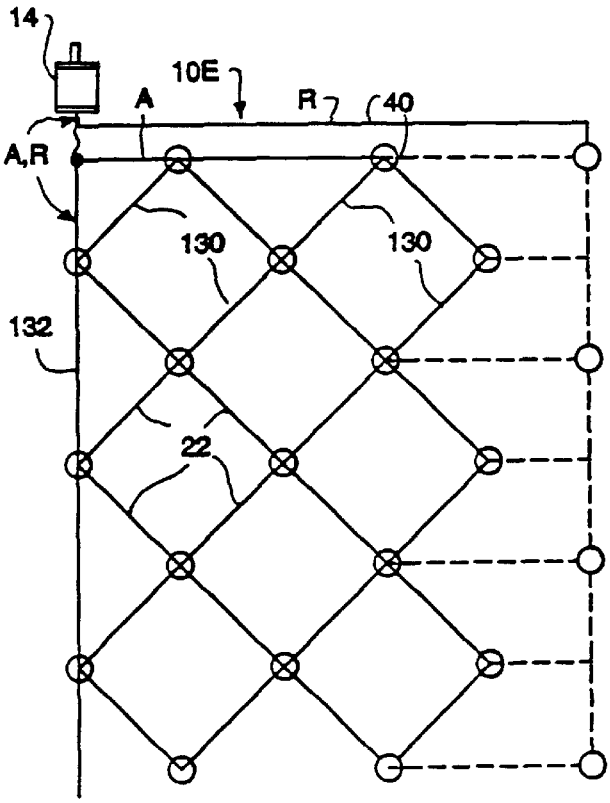
FIG. 5B is a circuit diagram and physical layout for the net light according to the present invention formed from the light set of FIG. 5A.

Referring now to FIG. 5B, the light strings 130 of the light set 20E disclosed in FIG. 5A are then physically fastened as follows: The lamp sockets of one light string 130 of a closely adjacent pair 136 are physically fastened to the corresponding horizontally aligned intermediate lengths 22 of an adjacent light string 130 of a different closely adjacent pair 136. The intermediate lengths 22 of the first and last light strings 132, 134 are physically fastened to the lamp sockets of the next adjacent light string 130 (the second light string in the case of the first light string 132, and the penultimate light string 130 in the case of the last light string 134). Alternatively, the lamp sockets of the first and last light strings 132, 134 are physically fastened to the intermediate lengths 22 of the next adjacent light string 130--that is, the lamp sockets of the first light string 132 may be connected to the intermediate lengths of the second light string 130, and the lamp sockets of the last light string 134 may be connected to the intermediate lengths 22 of the penultimate light string 130. In either instance, the net light 10E thus produced contains light nodes--that is, lamp sockets and lamps disposed at the nodes where two adjacent light strings 130 are physically connected together.

Figure 2A:
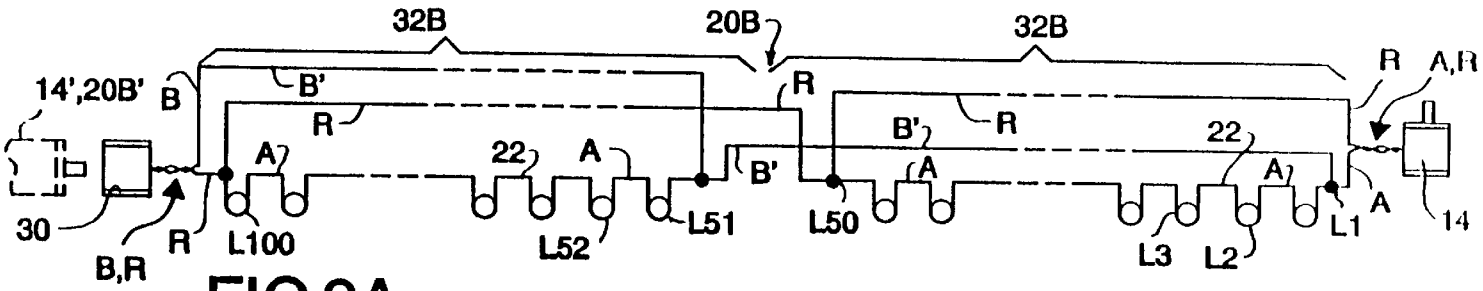
FIG.2A PRIOR ART
FIG. 2A is a circuit diagram of another linear light set.
Figure 2B:
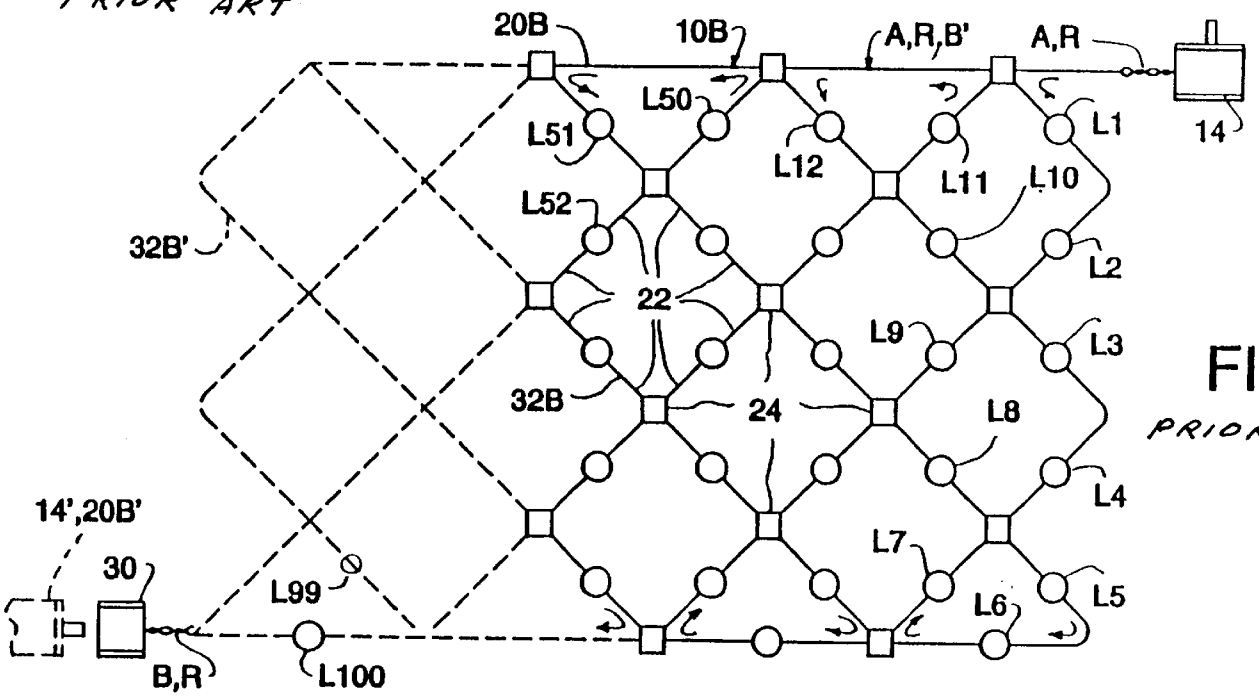
FIG.2B PRIOR ART
FIG. 2B is a circuit diagram and physical layout for a net light formed from the linear light sets of FIG. 2A.

While the light nets 10B, 10C and 10D illustrated in FIGS. 2B, 3B and 4B, respectively, contain lamp sockets at various points excluding the nodes (or interconnections between adjacent light strings), and while the light net 10E illustrated in FIG. 5B contains lamp sockets only at the nodes, it is also possible to create a light net which has lamp sockets both intermediate the nodes and at the nodes, thereby to provide a more complex light net appearance.

Figure 1A:
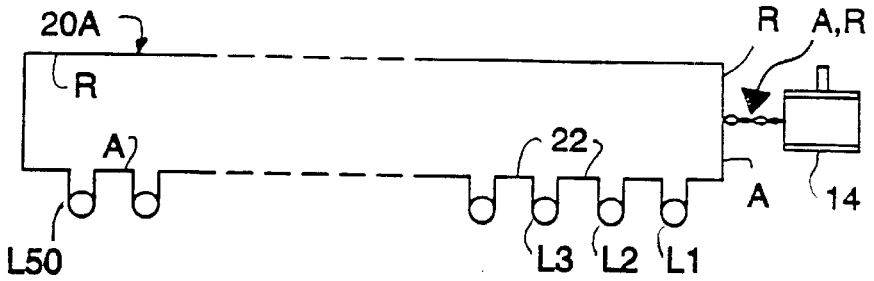
FIG.1A PRIOR ART
FIG. 1A is a circuit diagram of a linear light set construction.
Figure 1B:
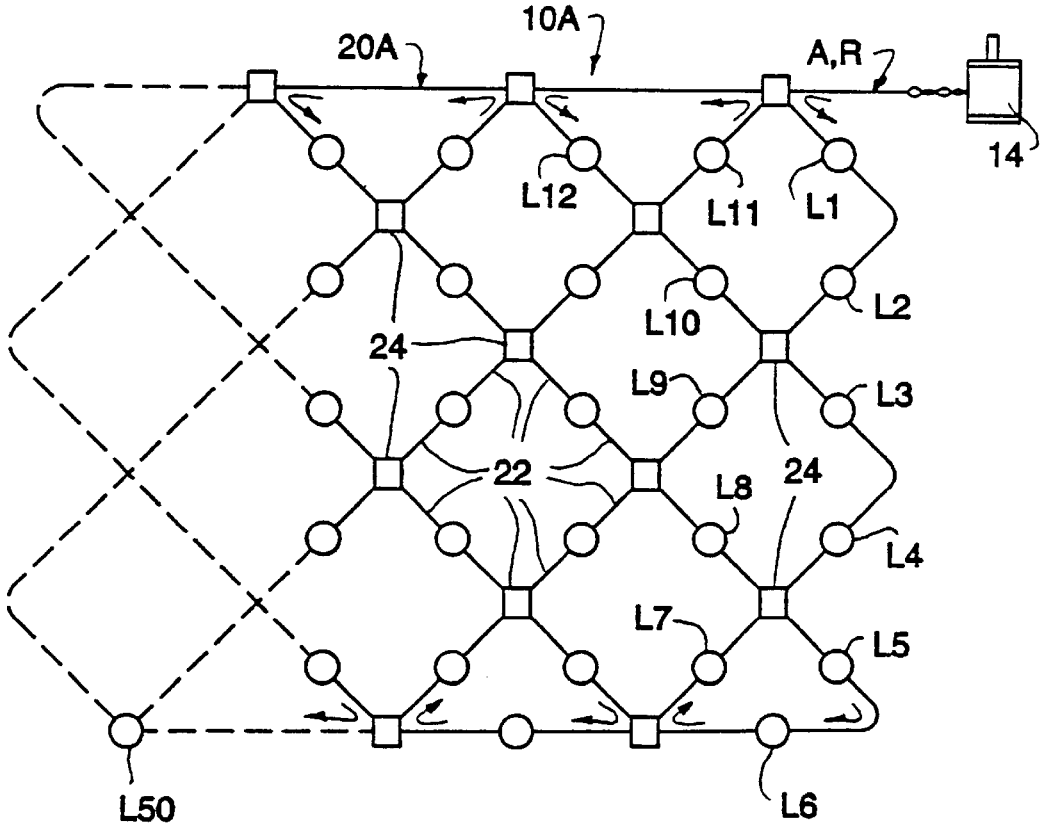
FIG.1B PRIOR ART
FIG. 1B is a circuit diagram and physical layout for a net light formed from the linear light set of FIG. 1A.

It will be appreciated that the extended length of any of the common wire means 40 and/or light strings 130 of FIGS. 3A, 4A and 5A is typically substantially less than the extended length of the linear light sets 20A, 20B of FIGS. 1A and 2A, and that, accordingly, the length of the wires which must be handled by the manufacturing staff or the manufacturing equipment is substantially less. Indeed, in the present invention the extended length of the longest light string 130 depending from the common wire means 40 is typically the longest length of wire which must be handled by the manufacturing staff or equipment. By way of contrast, the extended length of the linear light set to be handled by the manufacturing staff or equipment of the conventional net light is at least the sum of the several vertically extending paths defined by the linear light set used in the net light.

As will be apparent to those skilled in the net light arts, the connectors 24 may be dispensed with as separate entities, and instead a connector portion (not shown) may be provided on each lamp socket to enable a physical (but non-electrical) connection of that lamp socket of a light string with the intermediate length 22 of another light string.

For clarity of illustration, in each embodiment the twisting together of the wires has been shown only adjacent the plug and adjacent the optional end connector. However, it will be appreciated that in FIGS. 1A through 2B the active wire A, the return wire R, and any optional bypass wire B, B' are physically twisted together over the entire length of each light set. Similarly, in the various embodiments of the present invention shown in FIGS. 3A through 5B, the active, return, and any optional bypass wires A, R and B are physically twisted together only in the common wire means portion 40, with only the active and return wires A, R being physically twisted together in each light string 130, thereby to meet UL requirements.

While the net light 10E and the light set 20E have been described in the context of a net light composed of a single light set having no sub-sets, it would be obvious to make a net light with light nodes which is composed of several light sets (secured together by end connector-and-plug assemblies) and a plurality of sub-sets in at least one of the light sets.

The present invention further encompasses net lights made according to the methods described hereinabove.

To summarize, the present invention provides a method of making a net light which is easier and more economical than that conventionally used to make net lights, which can produce net lights either with or without light nodes as desired, and which reduces the extended length of the light set employed in forming the net light.

As described hereinabove and in U.S. patent application No. 09/244,647, filed Feb. 4, 1999, a net or mesh light set may be formed from a common wire portion (containing active and return wires, or active, return and bypass wires) and a plurality of originally parallel light strings. Each light string contains a plurality of lamp sockets and a plurality of intermediate lengths of wire— that is, intermediate lengths of the active and return wires. The various light strings are joined together at the tops thereof (by the common wire means portion) and depend downwardly, in a generally parallel orientation from the common wire portion. Preferably adjacent pairs of light strings extend downwardly in columns that are deformed or re-oriented in order to make the net or mesh design so that in each light string (except the first and last, which are special cases) the lamp sockets on that particular light string are divided into two alternating sets. In any given one of such light strings, one set of alternating lamp sockets is secured on one side to one adjacent light string, and the other alternating set of lamp sockets is secured on the other side to the other adjacent light string. Accordingly, the initially parallel light strings are deformed or re-oriented into an undulating "S" shape. The undulating "S" shape diminishes the overall height of the net because each light string is no longer extending from the top to the bottom directly (in a straight line, the shortest distance between two points), but rather is undulating from side to side along its length. Depending upon the spacing of the adjacent (initially parallel) light strings of a pair, the undulating "S" shape decreasse the overall theoretical length of the light strings by variable percent. Accordingly, the net or mesh light set provides less coverage for the same price or must sell for a higher price for the same length light set in order to compensate for the extra electrical wiring required.

Accordingly, the present invention has as fourth and fifth preferred embodiments a net or mesh light set which is economical and a method of making the same which is similarly economical. More particularly, it is the object of the preferred embodiment to provide such light set, and a method making the same, wherein the initially parallel light strings thereof remain parallel even after the several light strings have been secured together, the intersection or nodes of the transverse lines and the depending lines of the net or mesh being at the lamp sockets.

Figure 6A:
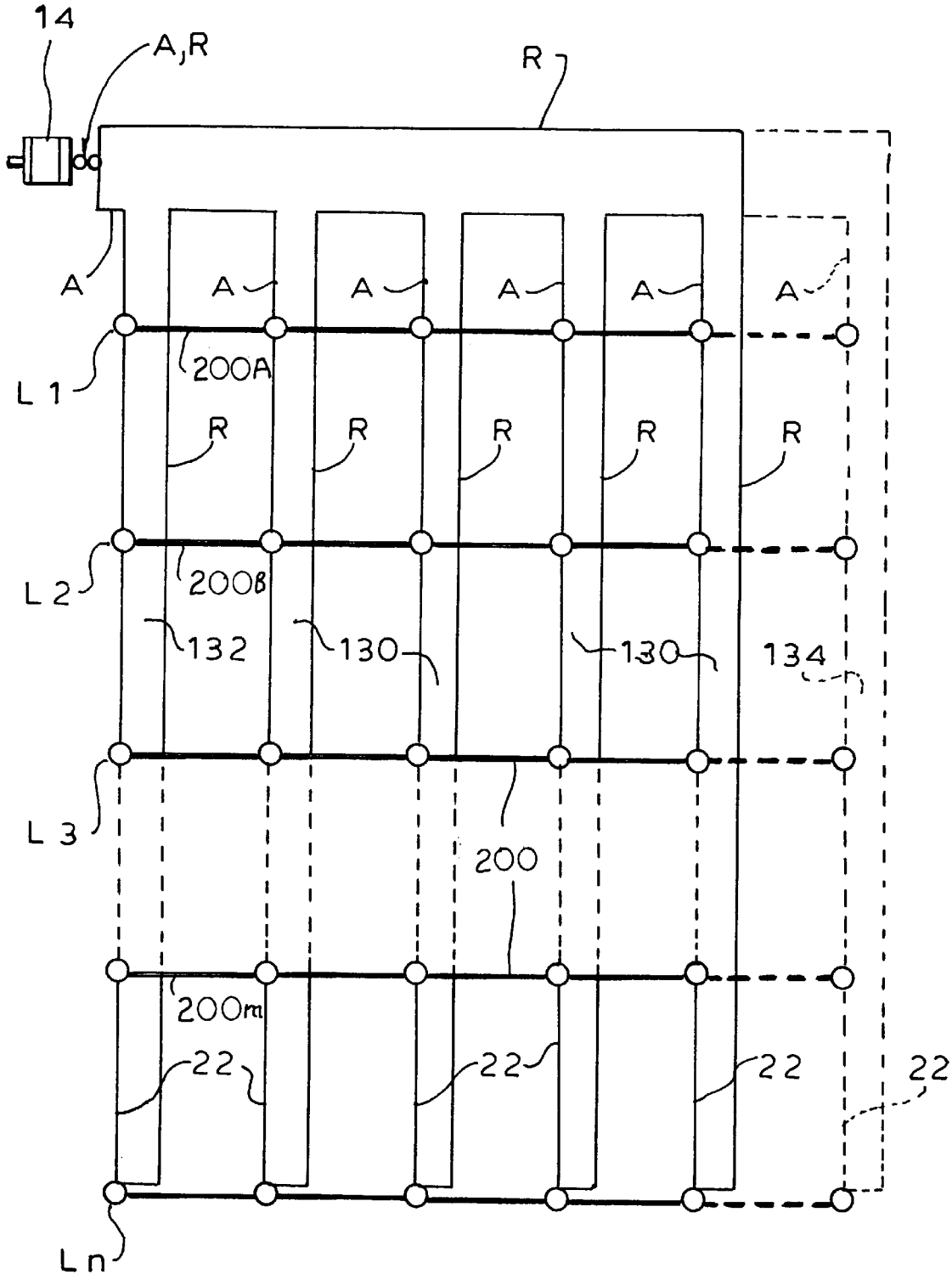
FIG. 6A is a view similar to FIG. 3B, but showing a fourth embodiment of the present invention.
Figure 6B:
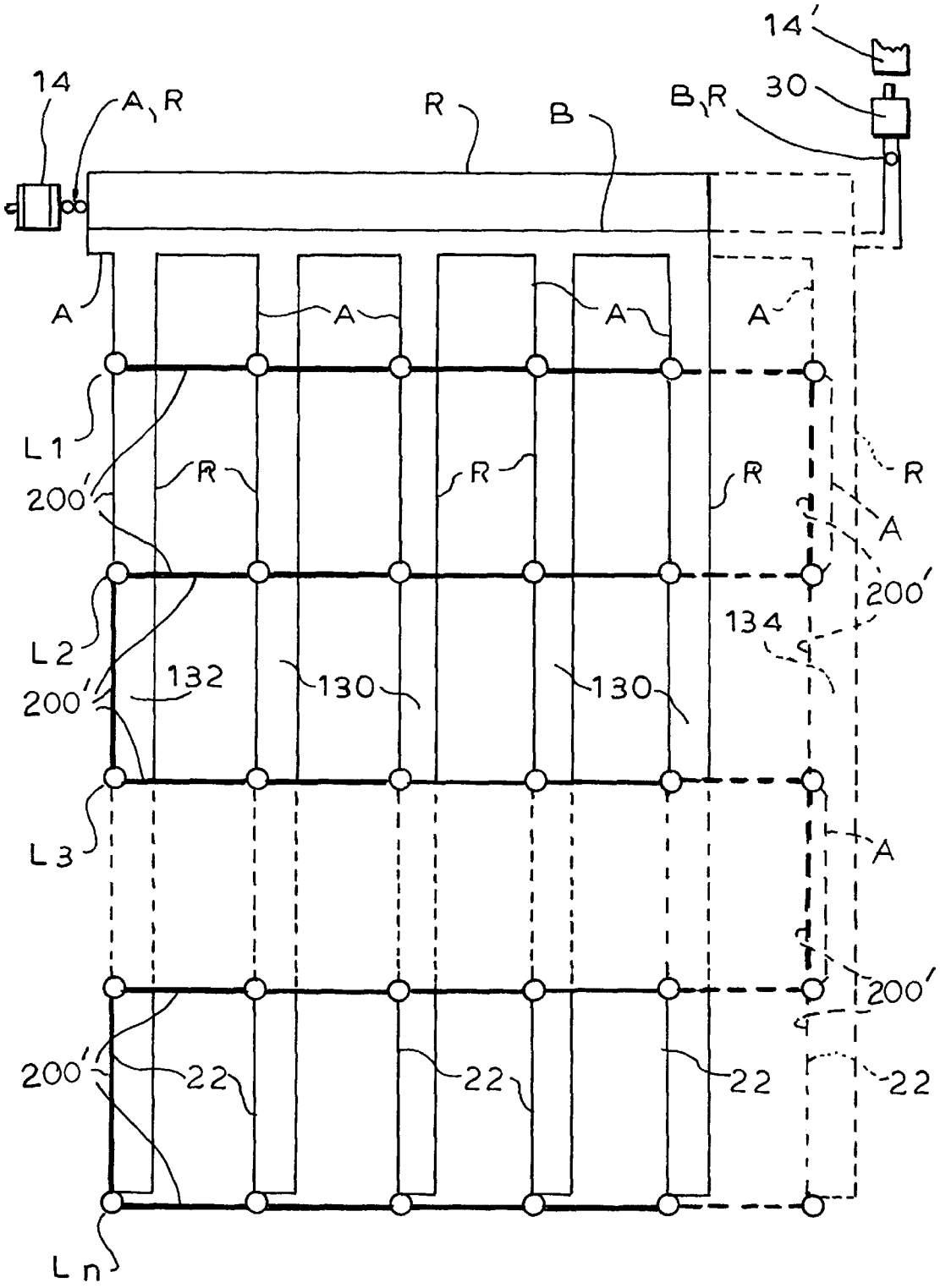
FIG. 6B is a view similar to FIG. 3B, but showing a fifth embodiment of the present invention.

Referring now to the drawing, and in particular to FIG. 6A and 6B thereof, FIG. 6A (the fourth embodiment) is similar to FIG. 3A generally, and FIG. 6B(the fifth embodiment) is similar to FIG. 4A generally, but each differs in certain particular aspects. Thus, the twisted light strings 130 of the fourth and fifth embodiments, including the first light string 132 and the last light string 134, are disposed across the light set width as equidistantly spaced light strings, preferably (as illustrated) with each light string 130 being of equal length. Further, the lamp sockets L1, L2 . . . Ln, of the first and last light strings 132, 134 are not vertically offset from the corresponding lamp sockets L1, L2 . . . Ln of the intermediate strings 130, but rather are disposed in horizontal alignment therewith. Preferably the horizontally spaced light strings 130 (including 132, 134) form equidistantly spaced columns descending from the common wire means 40 and the lamp sockets (all L1's, all L2's... all Ln's) are disposed in horizontal or substantially transverse rows across the width of the light set and are equidistantly spaced from the common wire means 40. It is well within the competence of one skilled in the electrical art to appropriately position the light strings 130 and the light sockets L1, L2 . . . Ln along the light strings 130 to obtain the described configuration.

As the various columns or light strings 130 define the parallel columns of the net light, it is only necessary to provide the transverse rows without disturbing the parallel columns. To this end, non-electrical ropes 200 are physically secured to the lamp sockets L1, L2 . . . Ln of the plurality of light strings 130, which lamp sockets are removed a common distance along the second direction (preferably vertically) from the common wire means 40 in order to form (with the light strings 130) a net or mesh. Thus, a first non-electrical rope 200A connects all of the first or highest lamp sockets L1 of the various light strings 130, a second non-electrical rope 200B connects all of the second or next highest lamp sockets L2 of the various light strings 130, etc., and a last non-electrical rope 200n connects all of the lowest or last lamp sockets Ln of the various light strings 130.

The length of each rope 200 may be only about the width of the light set. In order to make the rows of the net or mesh of equal significance with the columns of the net or mesh, preferably the rope is approximately of the same thickness and color as the light strings. (For illustrative purposes, in FIGS. 6A and 6B the ropes 200 are illustrated as thicker than the various wires.) Indeed, the ropes may be made of the same insulating material as the outside of the active and return wires of a light string, but the ropes 200 are preferably of a greater thickness so that the thickness of each rope matches the thickness of a twisted light string 130. The absence of any electrical wire within the rope 200 greatly reduces the cost thereof and suffices to render both the light set and its method of manufacture economical.

While the fourth embodiment (FIG. 6A) illustrates a plurality of ropes 200 (200A, 200B, etc.) equal in number to the number of lamp sockets Ln in the light string, the fifth embodiment (FIG. 6B) illustrates the use of a single rope 200' which joins all of the lamp sockets Ln of all of the light strings 130. While the undulating or S-shaped curvature of such a single rope 200' causes a greater length of the rope 200' to be used for a given light set, the additional expense is minimal as there is no expensive copper within the rope 200'. Accordingly, whether to use a single long rope 200' or a plurality of separate short ropes 200 depends more appropriately on the ease of manufacture of the light sets, balancing the difficulties involved in handling the longer length of rope 200' against the difficulties involved in handling a plurality of shorter ropes 200.

In the net lights illustrated in FIGS. 6A and 6B the nodes or intersection points between the vertically extending light strings 130 and the horizontally extending ropes 200 (or portions of the rope 200') are disposed at the lamp sockets. It is well known to form a lamp socket with a hook portion configured and dimensioned to receive (preferably removably) a wire therethrough. While such lamp sockets are preferably used in the preferred embodiment, alternatively the rope(s) 200, 200' may simply be wound about and secured to each of the lamp sockets in a row to achieve substantially the same result of securing together the row of lamp sockets with the rope(s).

As will be apparent to those skilled in the art, the preferred embodiment illustrated in FIG. 6A may be modified to include a bypass wire B in the common wire portion 40 and an end connector 30 containing a return wire R and a bypass wire B, as illustrated in FIG. 6B, in order to enable the plug 14' of an additional light set to be electrically connected therewith.

To summarize, the preferred embodiments of the present invention provides a net or mesh light set (with lamps sockets and lamps located at the nodes) which is simple and economical to manufacture, use and maintain. The initially parallel lights strings of the light set remain parallel even after the several light strings have been secured together by rope(s).

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. An economical method of making a net light with light nodes, comprising the steps of:

(A) providing a light set having:

(i) a common wire means extending in a first direction, the common wire means including an active wire and a return wire;

(ii) a plurality of series-connected light strings extending physically parallel to each other and in a second direction substantially transverse to said first direction, each light string including a plurality of lamp sockets and a plurality of intermediate lengths of wire connecting the lamp sockets in series; and (iii) plug means disposed at one end of the common wire means and including the active and return wires; and (B) physically fastening a non-electrical rope to the lamp sockets of the plurality of light strings removed a common distance along the second direction from the common wire means, thereby forming a mesh.

2. The method of claim 1 wherein the light set is in turn comprised of a plurality of light sub-sets wired in parallel, each light sub-set including:

(i) a common wire means portion extending in said first direction, the common wire means portion including the active and return wires; and (ii) a plurality of series-connected light strings extending physically parallel to each other, and in the second direction substantially transverse to the first direction, each light string including a plurality of lamp sockets and a plurality of intermediate lengths of wire electrically and physically connecting the lamp sockets in series.

3. The method of claim 1 wherein each light string comprises an active wire and a return wire.

4. The method of claim 3 wherein the active wire and return wire are physically twisted together in the common wire means portion, and the active and return wires are physically twisted together in each light string.

5. An economical method of making a net light with light nodes from a plurality of light sets, comprising the steps of:

(A) providing a plurality of parallel wired light sets, at least one light set having:

(i) a common wire means extending in a first direction, the common wire means including an active wire, a return wire, and a bypass wire;

(ii) a plurality of series-connected light strings extending physically parallel to each other, and in a second direction substantially transverse to the first direction, each light string including a plurality of lamp sockets and a plurality of intermediate lengths of wire electrically and physically connecting the lamp sockets in series;

(iii) plug means disposed at one end of the common wire means and including the active and return wires; and (iv) connector means disposed at an opposite end of the common wire means and including the bypass and return wires; and (B) physically fastening a non-electrical rope to the lamp sockets of the plurality of light strings removed a common distance along the second direction from the common wire, thereby forming a mesh.

6. The method of claim 5 wherein each of the light sets is in turn comprised of a plurality of light sub-sets wired in parallel, each light sub-set including:

(i) a common wire means portion extending in said first direction, the common wire means portion including the active wire, the return wire, and the bypass wire; and (ii) a plurality of series-connected light strings extending physically parallel to each other, and in the second direction substantially transverse to the first direction, each light string including a plurality of lamp sockets and a plurality of intermediate lengths of wire electrically and physically connecting the lamp sockets in series.

7. The method of claim 6 wherein each light string comprises an active wire and a return wire.

8. The method of claim 6 wherein the active, return and bypass wires are physically twisted together in the common wire means portion, and the active and return wires are physically twisted together in each light string.

9. A net light made according to the method of claim 1.

10. A net light made according to the method of claim 2.

11. A net light made according to the method of claim 5.

12. A net light made according to the method of claim 6.

13. An economical net light with light nodes, comprising a light set having:

(A) a common wire means extending in a first direction, said common wire means including an active wire and a return wire;

(B) a plurality of series-connected light strings extending physically parallel to each other and in a second direction substantially transverse to said first direction, each said light string including a plurality of lamp sockets and a plurality of intermediate lengths of wire connecting said lamp sockets in series;

(C) plug means disposed at one end of said common wire means and including said active and return wires; and (D) a non-electrical rope physically fastened to said lamp sockets of said plurality of light strings removed a common distance along the second direction from said common wire means, thereby forming a mesh.

14. The net light of claim 13 wherein said light set is in turn comprised of a plurality of light sub-sets wired in parallel, each said light sub-set including:

(i) a common wire means portion extending in said first direction, said common wire means portion including said active and return wires; and (ii) a plurality of series-connected light strings extending physically parallel to each other and a second direction substantially transverse to the first direction, each said light string including a plurality of said lamp sockets and a plurality of said intermediate lengths of wire electrically and physically connecting said lamp sockets in series.

15. The net light of claim 13 wherein each said light string comprises an active wire and a return wire.

16. The net light of claim 15 wherein said active wire and return wire are physically twisted together in said common wire means portion, and said active and return wires are physically twisted together in each said light string.

17. An economical net light with light nodes formed from a plurality of light sets, comprising:

(A) a plurality of parallel wired light sets, at least one said light set having:

(i) a common wire means extending in a first direction, said common wire means including an active wire, a return wire, and a bypass wire;

(ii) a plurality of series-connected light strings extending physically parallel to each other, and in a second direction substantially transverse to the first direction, each said light string including a plurality of lamp sockets and a plurality of intermediate lengths of wire electrically and physically connecting said lamp sockets in series;

(iii) plug means disposed at one end of said common wire means and including said active and return wires;

(iv) connector means disposed at an opposite end of said common wire means and including said bypass and return wires; and (B) a non-electrical rope physically fastening said lamp sockets of said plurality of light strings removed a common distance along said second direction from said common wire means, thereby forming a mesh.

18. The net light of claim 17 wherein each of the light sets is in turn comprised of a plurality of light sub-sets wired in parallel, each light sub-set including:

(i) a common wire means portion extending in said first direction, said common wire means portion including the active wire, the return wire, and the bypass wire; and (ii) a plurality of series-connected light strings extending physically parallel to each other and in a second direction substantially transverse to the first direction, each said light string including a plurality of said lamp sockets and a plurality of said intermediate lengths of wire electrically and physically connecting said lamp sockets in series.

19. The net light of claim 18 wherein each said light string comprises an active wire and a return wire.

20. The net light of claim 18 wherein said active, return and bypass wires are physically twisted together in said common wire means portion, and said active and return wires are physically twisted together in each said light string.

* * * * *